US012121193B2

(12) United States Patent
Jung et al.

(10) Patent No.: US 12,121,193 B2
(45) Date of Patent: Oct. 22, 2024

(54) ROBOT CLEANER AND METHOD FOR CONTROLLING SAME

(71) Applicant: EVERYBOT INC., Seongnam-si (KR)

(72) Inventors: Woo Chul Jung, Hwaseong-si (KR); Bong Yun Kim, Anyang-si (KR); Hwan Joo Kim, Yeoju-si (KR)

(73) Assignee: EVERYBOT INC., Seongnam-si (KR)

( * ) Notice: Subject to any disclaimer, the term of this patent is extended or adjusted under 35 U.S.C. 154(b) by 807 days.

(21) Appl. No.: 17/044,209

(22) PCT Filed: Mar. 28, 2019

(86) PCT No.: PCT/KR2019/003611

§ 371 (c)(1),
(2) Date: Sep. 30, 2020

(87) PCT Pub. No.: WO2019/194464

PCT Pub. Date: Oct. 10, 2019

(65) Prior Publication Data

US 2021/0127932 A1 May 6, 2021

(30) Foreign Application Priority Data

Apr. 2, 2018 (KR) ..... 10-2018-0038123

(51) Int. Cl.
*A47L 11/40* (2006.01)
*A47L 11/293* (2006.01)

(52) U.S. Cl.
CPC ..... *A47L 11/4011* (2013.01); *A47L 11/293* (2013.01); *A47L 11/4061* (2013.01); *A47L 11/4066* (2013.01); *A47L 2201/04* (2013.01)

(58) Field of Classification Search
CPC ..... A47L 11/4011; A47L 11/293; A47L 11/4061; A47L 11/4066; A47L 2201/04; A47L 11/4069; A47L 11/16; A47L 11/14
See application file for complete search history.

(56) References Cited

U.S. PATENT DOCUMENTS 7,761,954 B2 * 7/2010 Ziegler ..... A47L 11/4061 15/340.1
8,387,193 B2 * 3/2013 Ziegler ..... A47L 11/4088 15/340.1

(Continued)

FOREIGN PATENT DOCUMENTS

CN 1423025 A 6/2003
CN 107278132 A 10/2017

(Continued)

*Primary Examiner* — Bhavesh V Amin
(74) *Attorney, Agent, or Firm* — Bridgeway IP Law Group, PLLC; Sang Ho Lee; Hyun Woo Shin

(57) ABSTRACT

Provided are a cleaning robot and a control method thereof. A control method of a cleaning robot using a rotational force of a plurality of rotation members as a motive power source for its driving, includes: driving the cleaning robot by rotating at least one of a first rotation member performing a rotational motion around a first rotation axis and a second rotation member performing a rotational motion around a second rotation axis; determining whether the cleaning robot reaches a wall surface during its driving; and driving the cleaning robot along the wall surface by rotating at least one of the first and second rotation members while maintaining one side surface of the cleaning robot to be in close contact with the wall surface when it is determined that the cleaning robot reaches the wall surface.

8 Claims, 9 Drawing Sheets

(56) References Cited

U.S. PATENT DOCUMENTS 8,670,866 B2 * 3/2014 Ziegler ..... A47L 11/302 318/609
8,774,966 B2 * 7/2014 Ziegler ..... A47L 11/4088 700/245
8,855,813 B2 * 10/2014 Ziegler ..... A47L 11/4061 700/258
9,445,702 B2 * 9/2016 Ziegler ..... A47L 9/2857
9,474,427 B2 * 10/2016 Lee ..... A47L 9/2805
9,504,367 B2 * 11/2016 Kim ..... G05D 1/024
9,560,947 B2 * 2/2017 Park ..... A47L 11/4038
9,706,891 B2 * 7/2017 Ziegler ..... A47L 9/2873
9,931,011 B2 * 4/2018 Kim ..... A47L 11/283
10,034,591 B2 * 7/2018 Park ..... A47L 11/283
10,149,590 B2 * 12/2018 Jeong ..... A47L 11/4038
10,213,081 B2 * 2/2019 Ziegler ..... A47L 11/4011
10,271,692 B2 * 4/2019 West ..... A47L 13/22
10,555,655 B2 * 2/2020 Jeong ..... A47L 11/4066
10,786,133 B2 * 9/2020 Jang ..... A47L 11/4038
11,185,204 B2 * 11/2021 Ziegler ..... F04D 29/4233
11,490,776 B2 * 11/2022 Jang ..... A47L 11/4013
11,647,878 B2 * 5/2023 Fogarty, Jr. ..... F04D 25/08 15/319
2007/0016328 A1 * 1/2007 Ziegler ..... B60R 19/483 318/609
2008/0134458 A1 * 6/2008 Ziegler ..... A47L 11/40 15/340.1
2008/0140255 A1 * 6/2008 Ziegler ..... B60B 33/0049 15/4
2008/0155768 A1 * 7/2008 Ziegler ..... A47L 11/4083 15/340.1
2011/0271469 A1 * 11/2011 Ziegler ..... B60B 33/0039 901/1
2012/0036659 A1 * 2/2012 Ziegler ..... A47L 11/40 700/258
2012/0167917 A1 * 7/2012 Gilbert, Jr. ..... A47L 11/408 134/6
2012/0311810 A1 * 12/2012 Gilbert, Jr ..... A47L 11/4044 15/300.1
2013/0000675 A1 * 1/2013 Hong ..... G05D 1/0246 15/49.1
2013/0241217 A1 * 9/2013 Hickey ..... B25J 19/0091 293/117
2014/0090201 A1 * 4/2014 Gilbert, Jr. ..... A47L 11/408 15/98
2014/0127975 A1 * 5/2014 Roy ..... A47L 11/4005 451/259
2014/0196231 A1 * 7/2014 Park ..... A47L 11/4069 15/98
2014/0289992 A1 * 10/2014 Ziegler ..... A47L 11/4083 15/98
2015/0026920 A1 * 1/2015 Hsu ..... A47L 11/4066 15/403
2015/0142169 A1 * 5/2015 Kim ..... G05D 1/0238 15/98
2015/0342431 A1 * 12/2015 Zydek ..... A47L 9/0472 15/366
2017/0035263 A1 * 2/2017 Kim ..... A47L 11/4011
2017/0049286 A1 * 2/2017 Ziegler ..... B60B 33/0021
2017/0071435 A1 * 3/2017 Jeong ..... A47L 11/4008
2017/0112344 A1 * 4/2017 Koura ..... A47L 11/4041
2017/0280960 A1 * 10/2017 Ziegler ..... A47L 11/4069
2017/0344013 A1 * 11/2017 Haegermarck ..... G05D 1/0274
2018/0206691 A1 * 7/2018 Jang ..... A47L 11/4011
2019/0142236 A1 * 5/2019 Ziegler ..... B60B 33/0068
2020/0345194 A1 * 11/2020 Jang ..... A47L 11/4013

FOREIGN PATENT DOCUMENTS

JP 2003-299601 A 10/2003
JP 2016-201096 A 12/2016
KR 10-1995-0012988 B1 10/1995
KR 96-3897 A 2/1996
KR 10-2003-0046325 A 6/2003
KR 10-2007-0106864 A 11/2007
KR 10-2016-0090571 A 8/2016

* cited by examiner

ROBOT CLEANER AND METHOD FOR CONTROLLING SAME

TECHNICAL FIELD

The present disclosure relates to a cleaning robot and a control method thereof, and more particularly, to a cleaning robot capable of autonomously moving and performing a mop cleaning and the like, and a control method thereof.

BACKGROUND ART

Various devices have been automated in accordance with the development of industrial technology. As well known, a cleaning robot has been used as a device that automatically cleans a cleaning target area by sucking or wiping a foreign material such as dust from a to-be-cleaned surface while being autonomously driven within the cleaning target area without a user's operation.

In general, the cleaning robot may include a vacuum cleaner performing the cleaning using suction force by a power source such as electricity.

The cleaning robot including such a vacuum cleaner has a limitation in that the cleaning robot is not able to remove a foreign material or ingrained dirt, adhered to the to-be-cleaned surface. In recent years, there has thus emerged a cleaning robot having a mop attached thereto and capable of performing a wet mopping or a mop cleaning.

However, the mop cleaning method used by a general cleaning robot is just a simple method of attaching a mop or the like to a bottom portion of a conventional vacuum cleaning robot, and may thus fail to effectively remove the foreign material and efficiently perform the mop cleaning.

In addition, the mop cleaning method used by the general cleaning robot allows the cleaning robot to be driven using methods of moving, avoiding an obstacle and the like used by a conventional suction type vacuum cleaner as they are, and may thus remove the dust and the like scattered on the to-be-cleaned surface, but may not easily remove the foreign material and the like adhered to the to-be-cleaned surface.

In particular, when the cleaning robot meets a wall surface during its driving, its function of continuing the cleaning while being driven along the wall surface is its main function that determines whether the cleaning is satisfactory. In particular, a lot of dust accumulated in an area where an indoor floor meets a corner between the wall surfaces may be easily noticed and it is thus very important to clean this area. In general, the conventional cleaning robot maintains a predetermined distance from the wall surface for its smooth driving. In order to compensate for the above problem, the cleaning robot may include a separate dust remover, however, the dust remover is only an auxiliary means of the cleaning, and is not a fundamental solution.

DISCLOSURE

Technical Problem

An object of the present disclosure is to provide a method and a structure enabling a cleaning robot to intensively clean a floor area where the cleaning robot meets a wall surface, the cleaning robot having a structure in which a mop is attached thereto to effectively remove a foreign material and the like adhered to a to-be-cleaned surface and a rotational force itself of its rotating member is used as a motive power source thereof, for example.

Another object of the present disclosure is to provide a cleaning robot having a highly satisfactory cleaning function during its driving by being driven while maintaining close contact with the wall surface even when reaching a wall surface edge or a corner area between the wall surfaces.

Still another object of the present disclosure is to provide a method of preventing a cleaning robot from being driven away from the wall surface during its driving for cleaning.

Yet still another object of the present disclosure is to provide a cleaning robot having an obstacle avoidance mode in which even when trouble occurs due to an obstacle, the cleaning robot may avoid the obstacle in an advantageous direction and restart its driving for cleaning.

Technical Solution

According to an aspect of the present disclosure, there is provided a control method of a cleaning robot using a rotational force of a plurality of rotation members as a motive power source for its driving, including: driving the cleaning robot by rotating at least one of a first rotation member performing a rotational motion around a first rotation axis and a second rotation member performing a rotational motion around a second rotation axis; determining whether the cleaning robot reaches a wall surface during its driving; and driving the cleaning robot along the wall surface by rotating at least one of the first and second rotation members while maintaining one side surface of the cleaning robot to be in close contact with the wall surface when it is determined that the cleaning robot reaches the wall surface.

In addition, the driving of the cleaning robot along the wall surface may include driving the cleaning robot while generating a pushing force between the cleaning robot and the wall surface by rotating at least one of the first rotation member and the second rotation member to maintain the cleaning robot to be in close contact with the wall surface.

In addition, the driving of the cleaning robot along the wall surface may further include rotating the cleaning robot in such a manner that a straight line connecting the first rotation axis and the second rotation axis to each other forms an acute angle with a direction in which the cleaning robot is scheduled to be driven in a state in which the cleaning robot is parallel to a floor surface on which the cleaning robot is driven, before the driving of the cleaning robot while generating the pushing force, and in the driving of the cleaning robot while generating the pushing force, a rotational speed of at least one of the first rotation member and the second rotation member may preferably be controlled to generate the pushing force by allowing the cleaning robot to be driven along the wall surface while maintaining the acute angle.

Meanwhile, the cleaning robot may include at least one distance detection unit, and in the driving of the cleaning robot while generating the pushing force, the rotational speed may be controlled based on a distance between the distance detection unit and the wall surface obtained through the distance detection unit to maintain the acute angle.

In addition, the distance detection unit may include a first distance detection unit and a second distance detection unit respectively disposed on the left and right sides of the body of the cleaning robot, and in the driving of the cleaning robot while generating the pushing force, the rotational speed may be controlled to maintain the acute angle in such a manner that a first reference value is maintained as a value of a difference in the distance between the distance detection unit and the wall surface obtained through the first distance detection unit and that obtained through the second distance detection unit.

In addition, the cleaning robot may include at least one distance detection unit, and the driving of the cleaning robot along the wall surface may further include: determining that the cleaning robot reaches a wall surface edge when a distance between the distance detection unit and the wall surface obtained through the distance detection unit has a value more than a predetermined second reference value or the magnitude of a distance detection signal of the distance detection unit has a value less than a predetermined third reference value; rotating the cleaning robot to be in close contact with the wall surface which is subsequently connected to the wall surface edge when it is determined that the cleaning robot reaches the wall surface edge; and driving the cleaning robot along the wall surface which is subsequently connected to the wall surface edge by rotating at least one of the first rotation member and the second rotation member in such a manner that the cleaning robot maintains its close contact with the wall surface which is subsequently connected to the wall surface edge, when the cleaning robot is in close contact with the wall surface which is subsequently connected to the wall surface edge.

In addition, the cleaning robot may include at least one distance detection unit, and the driving of the cleaning robot along the wall surface may further include: determining that the cleaning robot reaches a wall surface corner when a distance between the distance detection unit and the wall surface obtained through the distance detection unit has a value less than a predetermined fourth reference value or the magnitude of a distance detection signal of the distance detection unit has a value more than a predetermined fifth reference value; rotating the cleaning robot to be in close contact with the wall surface which is subsequently connected to the wall surface corner when it is determined that the cleaning robot reaches the wall surface corner; and driving the cleaning robot along the wall surface which is subsequently connected to the wall surface corner by rotating at least one of the first rotation member and the second rotation member in such a manner that the cleaning robot maintains its close contact with the wall surface which is subsequently connected to the wall surface corner, when the cleaning robot is in close contact with the wall surface which is subsequently connected to the wall surface corner.

Meanwhile, in the driving of the cleaning robot along the wall surface, the cleaning robot may preferably be maintained to be driven by a distance of at least twice a width of its body along the wall surface.

Meanwhile, the cleaning robot may include at least one distance detection unit, and in the determining of whether the cleaning robot reaches the wall surface, it may be determined whether the cleaning robot reaches the wall surface based on a distance between the distance detection unit and the wall surface obtained through the distance detection unit.

In addition, the distance detection unit may include a long distance detection unit and a short distance detection unit, and the determining of whether the cleaning robot reaches the wall surface may include: determining whether the distance between the distance detection unit and the wall surface obtained through the long distance detection unit has a value less than or equal to a predetermined sixth reference value; determining whether the distance between the distance detection unit and the wall surface obtained through the short distance detection unit has a value less than or equal to a predetermined seventh reference value, while maintaining a driving state of the cleaning robot, when it is determined that the distance has the value less than or equal to the sixth reference value; and determining that the cleaning robot reaches the wall surface when it is determined that the distance has the value less than or equal to the seventh reference value.

In addition, the determining of whether the cleaning robot reaches the wall surface may further include determining that the cleaning robot reaches the wall surface when a predetermined time elapses after the distance between the distance detection unit and the wall surface obtained through the long distance detection unit is determined to be less than or equal to the sixth reference value even if it is not determined that the distance between the distance detection unit and the wall surface obtained through the short distance detection unit is less than or equal to the seventh reference value.

Meanwhile, the driving of the cleaning robot along the wall surface may further include changing a mode of the cleaning robot to an obstacle avoidance mode when trouble occurs in the driving of the cleaning robot due to an obstacle, the obstacle avoidance mode including a process in which the cleaning robot is driven to be spaced apart from the wall surface for a predetermined distance or time and is then brought into close contact with the wall surface again, and the driving of the cleaning robot along the wall surface may be restarted as the obstacle avoidance mode is released after the cleaning robot is brought into close contact with the wall surface again.

According to another aspect of the present disclosure, there is provided a cleaning robot including: a body; a drive unit disposed in the body and supplying the cleaning robot with motive power for its driving; first and second rotation members supplying the cleaning robot with a motive power source for its driving by each performing a rotational motion around a first rotation axis and a second rotation axis by the motive power of the drive unit, and each having a cleaner for wet cleaning fixable thereto; and a control unit, wherein the control unit may drive the cleaning robot by rotating at least one of a first rotation member and a second rotation member, determine whether the cleaning robot reaches a wall surface during its driving, and drive the cleaning robot along the wall surface by rotating at least one of the first and second rotation members while maintaining the cleaning robot to be in close contact with the wall surface when it is determined that the cleaning robot reaches the wall surface.

In addition, the control unit may drive the cleaning robot while generating a pushing force between the cleaning robot and the wall surface by rotating at least one of the first rotation member and the second rotation member to maintain the cleaning robot to be in close contact with the wall surface.

The control unit may perform preliminary control to rotate the cleaning robot in such a manner that a straight line connecting the first rotation axis and the second rotation axis to each other forms an acute angle with a direction in which the cleaning robot is scheduled to be driven in a state in which the cleaning robot is parallel to a floor surface on which the cleaning robot is driven, before driving the cleaning robot while generating the pushing force, and may control a rotational speed of at least one of the first rotation member and the second rotation member to generate the pushing force by allowing the cleaning robot to be driven along the wall surface while maintaining the acute angle.

In addition, the cleaning robot may further include at least one distance detection unit, and the control unit may control the rotational speed based on a distance between the distance detection unit and the wall surface obtained through the distance detection unit to maintain the acute angle.

Meanwhile, the cleaning robot may further include at least one distance detection unit, and the control unit may determine whether the cleaning robot reaches the wall surface based on a distance between the distance detection unit and the wall surface obtained through the distance detection unit.

Advantageous Effects

According to the various embodiments of the present disclosure described above, the cleaning robot may intensively clean the floor area that meets the wall surface by being driven while having its one side surface in close contact with the wall surface.

In addition, according to the various embodiments of the present disclosure, the cleaning robot may provide increased satisfaction of cleaning by being driven while maintaining close contact with the wall surface even when reaching the wall surface edge or the corner area between the wall surfaces.

In addition, according to the various embodiments of the present disclosure, the cleaning robot may provide a cleaning effect similar to that of human cleaning by being prevented from being driven away from the wall surface during its driving for cleaning.

In addition, according to the various embodiments of the present disclosure, the cleaning robot may avoid the obstacle in an advantageous direction and restart its driving for cleaning even when trouble occurs due to an obstacle.

BEST MODE

Figure 1:
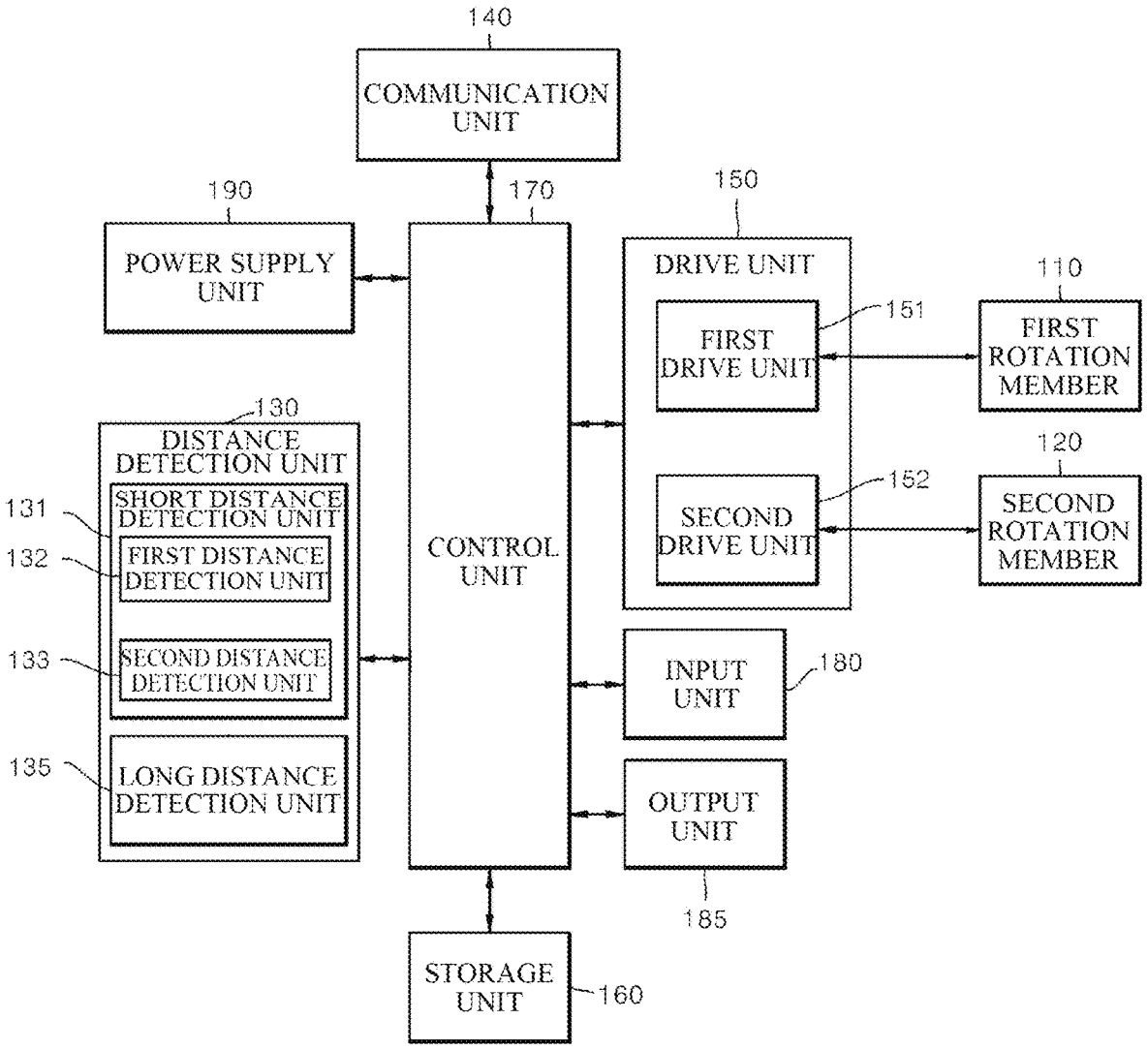
FIG. 1 is a block diagram showing a cleaning robot according to an embodiment of the present disclosure.

The following description merely illustrates a principle of the present disclosure. Therefore, those skilled in the art may implement the principle of the present disclosure and invent various devices included in the spirit and scope of the present disclosure although not clearly described or shown in the present specification. In addition, it is to be understood that all conditional terms and embodiments mentioned in the present specification are obviously intended only to allow those skilled in the art to understand a concept of the present disclosure in principle, and the present disclosure is not limited to the embodiments and states particularly mentioned as such.

Further, it is to be understood that all detailed descriptions mentioning specific embodiments of the present disclosure as well as principles, aspects, and embodiments of the present disclosure are intended to include structural and functional equivalences thereof. Further, it is to be understood that these equivalences include an equivalence that will be developed in the future as well as an equivalence that is currently well-known, that is, all elements invented to perform the same function regardless of a structure.

Therefore, it is to be understood that, for example, block diagrams of the present specification illustrate a conceptual aspect of an illustrative circuit for embodying the principle of the present disclosure. Similarly, it is to be understood that all flow charts, state transition diagrams, pseudo-codes and the like, illustrate various processes that may be tangibly embodied in a computer readable medium and that are executed by computers or processors regardless of whether or not the computers or the processors are clearly illustrated.

Functions of various elements including processors or functional blocks represented as concepts similar to the processors and illustrated in the accompanying drawings may be provided using hardware having capability to execute appropriate software as well as dedicated hardware. When the functions are provided by the processors, the functions may be provided by a single dedicated processor, a single shared processor or a plurality of individual processors and some of them may be shared with each other.

In addition, terms mentioned as a processor, a control or a concept similar to the processor or the control should not be interpreted to exclusively cite hardware having capability to execute software, but should be interpreted to implicitly include digital signal processor (DSP) hardware and a read only memory (ROM), a random access memory (RAM), and a non-volatile memory for storing software without being limited thereto. The above-mentioned terms may also include well-known other hardware.

In the claims of the present specification, components represented as means for performing functions mentioned in a detailed description are intended to include all methods for performing functions including all types of software including, for example, a combination of circuit devices performing these functions, firmware/micro codes or the like, and are coupled to appropriate circuits for executing the software to execute these functions. It is to be understood that functions provided by variously mentioned means are combined with each other and are combined with a method demanded by the claims in the present disclosure defined by the claims, and any means capable of providing these functions are thus equivalent to means recognized from the present specification.

The above-mentioned objects, features and advantages will become more obvious from the following detailed description associated with the accompanying drawings. Therefore, those skilled in the art to which the present disclosure pertains may easily practice a technical idea of the present disclosure. In addition, in describing the present disclosure, when it is decided that a detailed description for the known art related to the present disclosure may unnecessarily obscure the gist of the present disclosure, the detailed description thereof will be omitted.

Hereinafter, various embodiments of the present disclosure will be described in detail with reference to the accompanying drawings.

Figure 2:
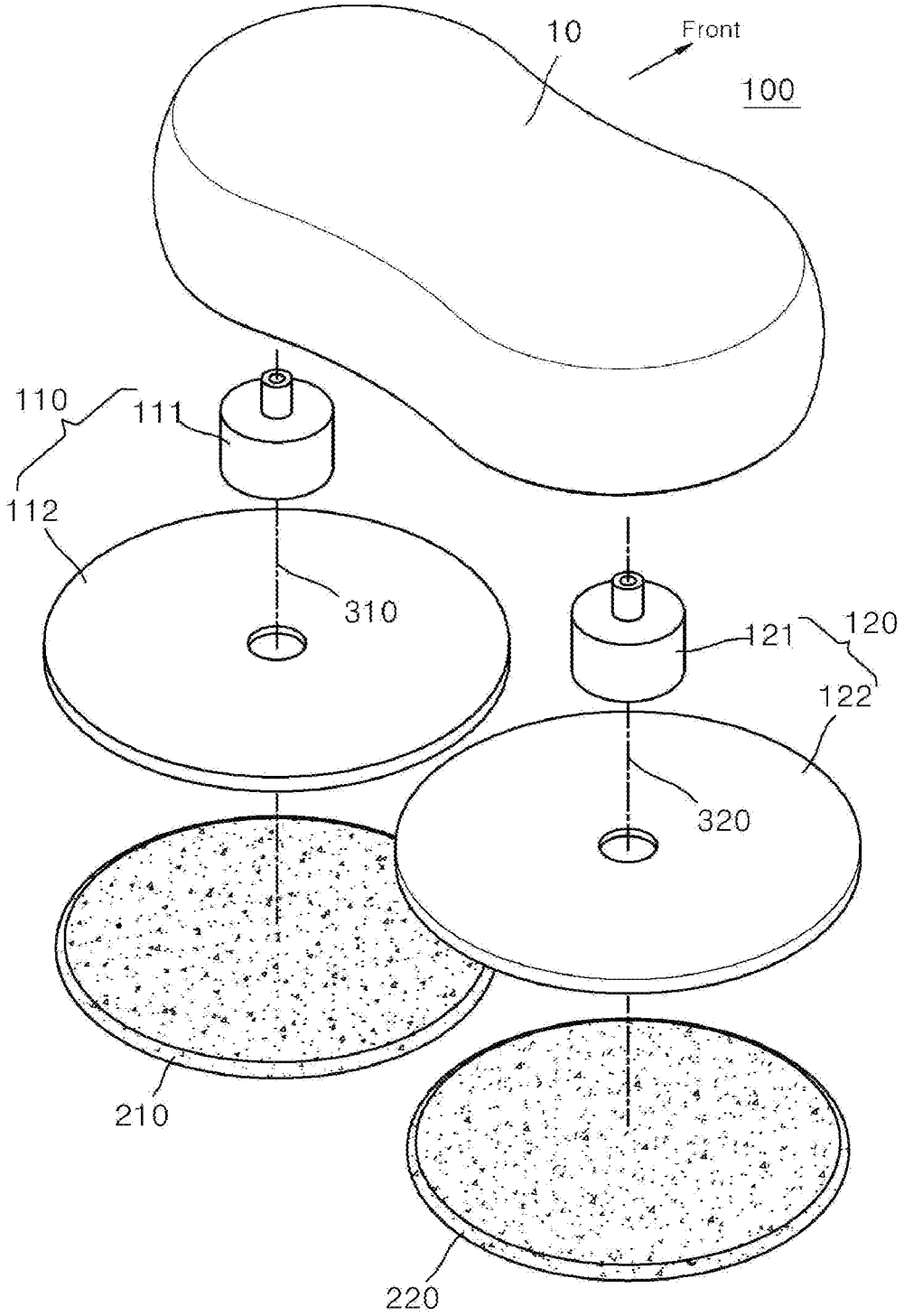
FIG. 2 is an exploded perspective view of the cleaning robot according to an embodiment of the present disclosure.
Figure 3:
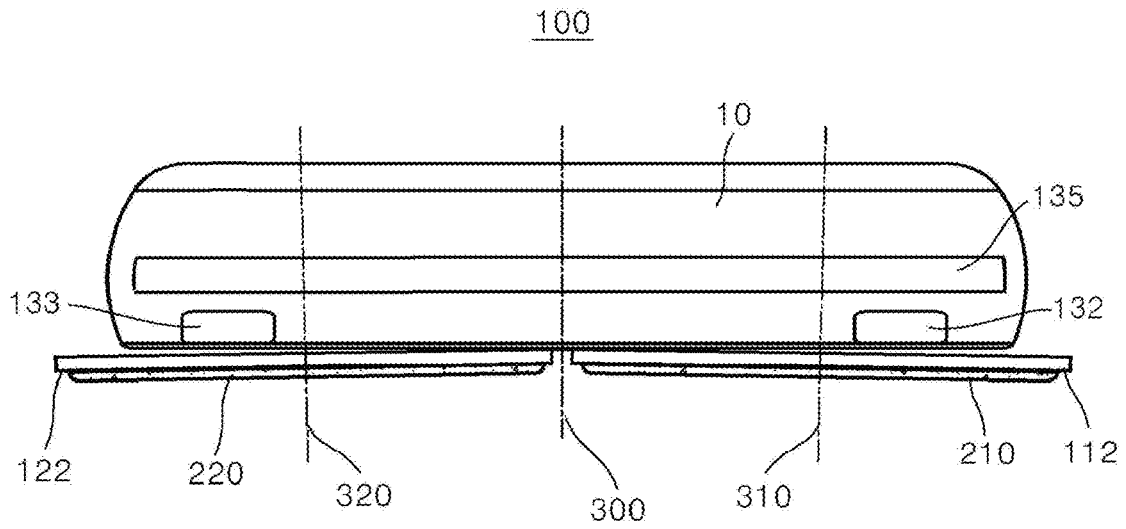
FIG. 3 is a front view of the cleaning robot according to an embodiment of the present disclosure.

FIGS. 1 to 3 are views for describing a structure of a cleaning robot according to an embodiment of the present disclosure. In more detail, FIG. 1 is a block diagram showing a cleaning robot according to an embodiment of the present disclosure; FIG. 2 is an exploded perspective view of the cleaning robot according to an embodiment of the present disclosure; and FIG. 3 is a front view of the cleaning robot according to an embodiment of the present disclosure.

Referring to FIGS. 1 to 3, a cleaning robot 100 according to the present disclosure includes: a body 10, a drive unit 150 installed in the body 10 to supply the cleaning robot 100 with motive power for its driving; first and second rotation members 110 and 120 supplying the cleaning robot 100 with a motive power source for its driving by each performing a rotational motion around a first rotation axis 310 and a second rotation axis 320 by the motive power of the drive unit 150, and each having a cleaner 210 or 220 for wet cleaning fixable thereto; and a control unit 170. In addition, the cleaning robot 100 may further include components such as: a distance detection unit 130 obtaining a distance between the cleaning robot 100 and its surrounding object; a communication unit 140 communicated with an external device; a storage unit 160 storing data; an input unit 180 receiving an operation mode from a user; an output unit 185 displaying a state of the cleaning robot 100 to the user; and a power supply unit 190 receiving power to drive the cleaning robot.

The drive unit 150 may include a first drive unit 151 installed in the body 10 and coupled to the first rotation member 110, and a second drive unit 152 installed in the body 10 and coupled to the second rotation member 120. Here, the drive unit 150 may be implemented including a motor, a gear assembly, etc.

The first rotation member 110 may include a first transmission member 111 coupled to the first drive unit 151 to transmit motive power by the first drive unit 151, and performing the rotational motion around the first rotation axis by the motive power. In addition, the first rotation member 110 may include a first fixing member 112 to which the first cleaner 210 for wet cleaning may be fixed.

In addition, the second rotation member 120 may include a second transmission member 121 coupled to the second drive unit 152 to transmit motive power by the second drive unit 152, and performing the rotational motion around the second rotation axis 320 by the motive power. In addition, the second rotation member 120 may include a second fixing member 122 to which the second cleaner 220 for the wet cleaning may be fixed. The cleaning robot 100 according to an embodiment may be driven while performing the wet cleaning using the cleaners 210 and 220 for the wet cleaning. Here, the wet cleaning may refer to cleaning performed by wiping a to-be-cleaned surface using the cleaners 210 and 220, and may include, for example, all the cleaning performed using a dry mop, a wet mop and the like. That is, the first cleaner 210 and the second cleaner 220 may each be made of a fibrous material such as a microfiber cloth, a mop, a non-woven cloth or a brush which may wipe various to-be-cleaned surfaces to remove a foreign material adhered to a floor surface through its rotational motion.

A cleaning robot 100 according to an embodiment may be driven while performing wet cleaning using cleaners 210 and 220 for the wet cleaning. Here, the wet cleaning may refer to cleaning performed by wiping a to-be-cleaned surface using the cleaners 210 and 220, and may include, for example, all the cleaning performed using a dry mop, a wet mop and the like. That is, the first cleaner 210 and the second cleaner 220 may each be made of a fibrous material such as a microfiber cloth, a mop, a non-woven cloth or a brush which may wipe various to-be-cleaned surfaces to remove a foreign material adhered to a floor surface through its rotational motion.

In addition, as shown in FIGS. 2 and 3, the cleaning robot 100 according to an embodiment of the present disclosure may have the rotation members 110 and 120 each having a wide width, and may thus be exposed to the outside of the body 10 when the cleaning robot 100 is viewed from above. The cleaning robot 100 may wipe every corner of a floor surface through this configuration.

Figure 4:
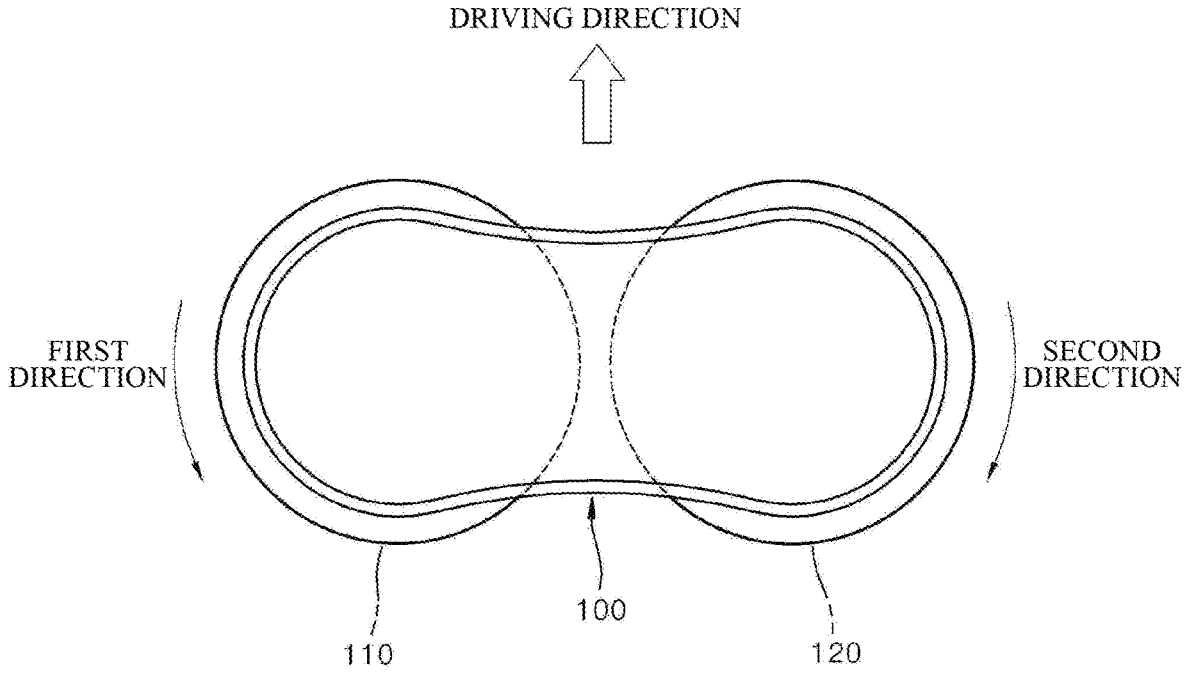
FIG. 4 is a view for describing a driving operation of the cleaning robot according to an embodiment of the present disclosure.

FIG. 4 is a view for describing a driving operation of the cleaning robot according to an embodiment of the present disclosure. As shown in FIG. 4, the cleaning robot 100 according to an embodiment of the present disclosure may remove the foreign material and the like adhered to a floor through friction between each of the cleaners and the to-be-cleaned surface as the first cleaner 210 and second cleaner 220 are rotated by the rotational motions of the first rotation member 110 and the second rotation member 120, respectively. In addition, a frictional force generated by the friction between each of the cleaners and the to-be-cleaned surface may be used as a motive power source of the cleaning robot 100.

In more detail, the moving speed and direction of the cleaning robot 100 according to an embodiment of the present disclosure may be adjusted depending on the magnitude and direction of a resultant force acting when the frictional force is generated between each of the cleaners and the to-be-cleaned surface as the first rotation member 110 and the second rotation member 120 are rotated, respectively.

In particular, referring to FIGS. 3 to 4, first and second rotation axes 310 and 320 of the first and second rotation members 110 and 120 may each be inclined at a predetermined angle with respect to a central axis 300 corresponding to a vertical axis of the cleaning robot 100 by the motive power of a pair of drive units 151 and 152. In this case, the first and second rotation members 110 and 120 may be inclined downward toward the outside with respect to the central axis. That is, an area located far from the central axis 300 among the areas of the first and second rotation members 110 and 120 may be more closely adhered to the to-be-cleaned surface than an area located close to the central axis 300.

Here, the central axis 300 may refer to the axis of the cleaning robot 100 that is vertical with respect to the to-be-cleaned surface. For example, assuming that the cleaning robot 100 cleans an X-Y plane formed by X and Y axes during its cleaning, the central axis 300 may refer to a Z axis, which is the axis of the cleaning robot 100 that is vertical with respect to the to-be-cleaned surface.

Meanwhile, the predetermined angle may include a first angle (a degree) corresponding to an angle at which the first rotation axis 310 is inclined with respect to the central axis 300 and a second angle (b degree) corresponding to an angle at which the second rotation axis 320 is inclined with respect to the central axis 300. Here, the first angle and the second angle may be the same or different from each other.

In addition, each of the first angle and the second angle may preferably be an angle within an angular range of 1 degree or more and 3 degrees or less. Here, the above-described angular range may be a range in which the cleaning robot 100 may maintain its optimal wet cleaning capacity, driving speed and driving performance. However, various embodiments of the present disclosure may not be limited to the above-described angular range.

Meanwhile, depending on the predetermined angle, when the pair of rotation members 110 and 120 is rotated, the relative frictional force generated between each of the cleaners and the to-be-cleaned surface may be greater in an outer edge of the body 10 than in its center. Therefore, the moving speed and direction of the cleaning robot 100 may be controlled by the relative frictional force generated by respectively controlling the rotation of the pair of rotation members 110 and 120.

Figure 5:
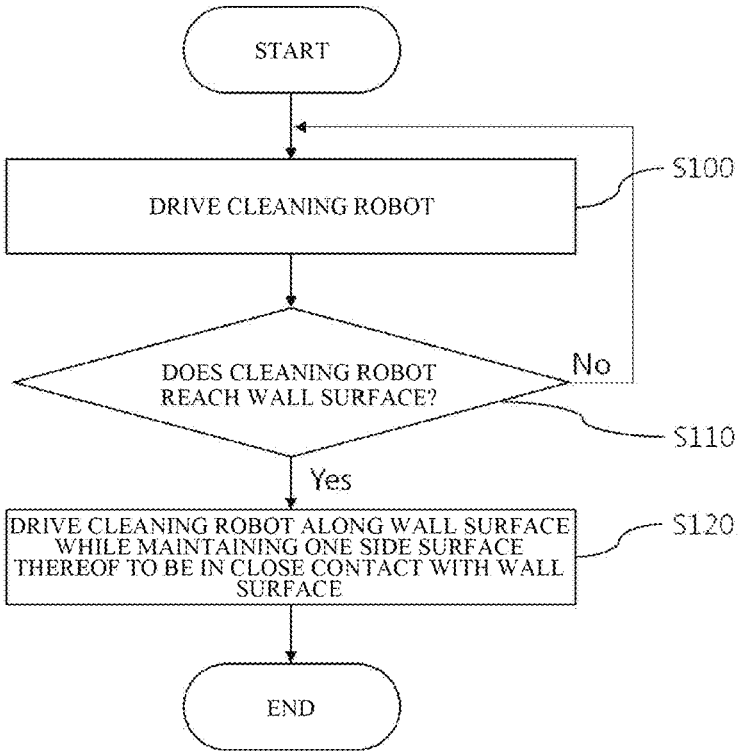
FIG. 5 is a flowchart showing a control method of the cleaning robot according to an embodiment of the present disclosure.

FIG. 5 is a flowchart showing a control method of the cleaning robot according to an embodiment of the present disclosure. As shown in FIG. 5, a control method of the cleaning robot 100 according to an embodiment of the present disclosure may include: driving the cleaning robot 100 by rotating at least one of a first rotation member 110 performing a rotational motion around a first rotation axis 310 and a second rotation member 120 performing a rotational motion around a second rotation axis 320 (S100); determining whether the cleaning robot 100 reaches a wall surface 800 during its driving (S110); and driving the cleaning robot 100 along the wall surface 800 by rotating at least one of the first and second rotation members 110 and 120 while maintaining one side surface of the cleaning robot 100 to be in close contact with the wall surface 800 when it is determined that the cleaning robot 100 reaches the wall surface 800 (S120). Here, 'one side surface' may refer to any one surface at the left and right sides of a front surface of the cleaning robot 100 when the front surface refers to a surface of the cleaning robot 100 in its normal driving direction. To 'maintain its close contact with the wall surface 800' may refer to a state in which there occurs continuous friction by allowing not an auxiliary component such as a duster but at least a portion of the body 10, rotation members 110 and 120 or fixing members 112 and 122, which may generate motive power of the cleaning robot 100, and the wall surface 800 to be in contact with each other. Here, the 'friction' may refer to any one or a combination of rolling friction and sliding friction.

Figure 6:
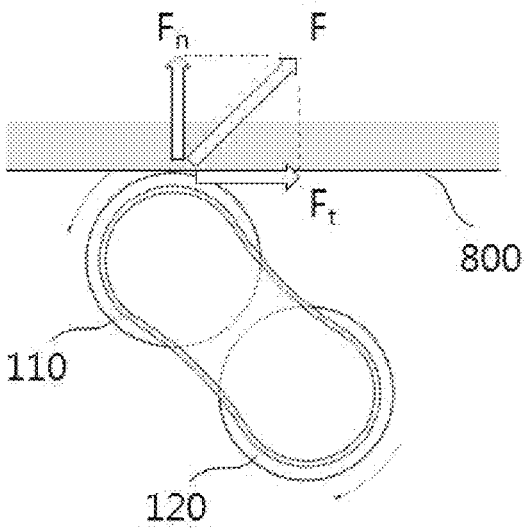
FIG. 6 is a view showing a vector of a force acting on a wall surface by the cleaning robot according to an embodiment of the present disclosure.

FIG. 6 is a view showing a vector of a force acting on a wall surface by the cleaning robot according to an embodiment of the present disclosure. The driving of the cleaning robot 100 along the wall surface 800 (S120) may include driving the cleaning robot 100 while generating a pushing force between the cleaning robot 100 and the wall surface 800 by rotating at least one of the first rotation member 110 and the second rotation member 120 to maintain the cleaning robot to be in close contact with the wall surface. This driving is described in detail with reference to FIG. 6. As shown in FIG. 6, according to an embodiment of the present disclosure, the vector representing the motive power of the cleaning robot 100, generated by rotating the rotation members 110 and 120 of the cleaning robot 100, may be F shown in FIG. 6. The wall surface 800 and the one side surface of the cleaning robot 100 are in close contact with each other, and the vector F of the motive power may thus be decomposed into a tangent direction component vector $F_t$ and a normal direction component vector $F_n$ of the wall surface 800 at the close contact point (That is, F is the resultant force of $F_t$ and $F_n$). In this case, the 'pushing force' may refer to the normal direction component vector $F_n$, and the tangent direction component vector $F_t$ may act in a direction in which the cleaning robot 100 is driven along the wall surface 800, and thus become motive power of the cleaning robot for its actual driving. Due to the above action of the pushing force, it is possible to prevent the cleaning robot 100 from being driven away from the wall surface 800 and ensure its satisfactory corner cleaning function such as a human cleaning.

Figure 7A:
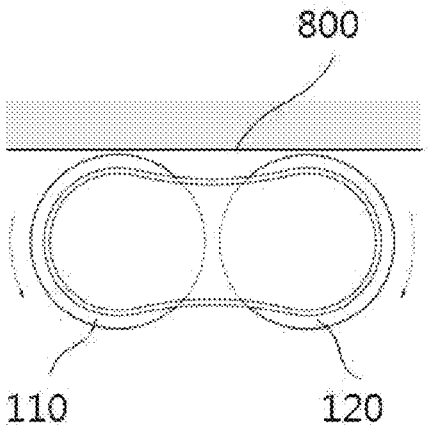
FIGS. 7A to 7C are views for describing a driving operation of the cleaning robot according to an embodiment of the present disclosure.
Figure 7B:
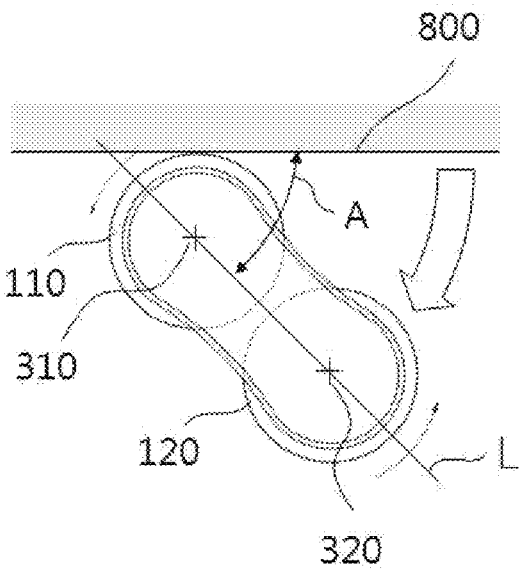
Figure 7C:
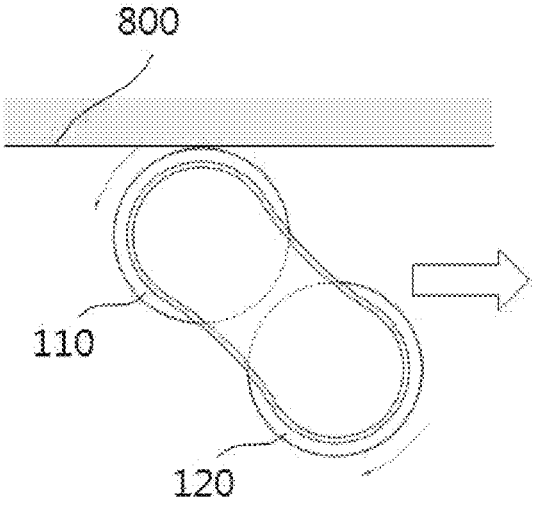

FIG. 7 is a view for describing a driving operation of the cleaning robot according to an embodiment of the present disclosure. As shown in FIG. 7, the driving of the cleaning robot 100 along the wall surface 800 (S120) may further include rotating the cleaning robot 100 (see FIG. 7B) in such a manner that a straight line connecting the first rotation axis 310 and the second rotation axis to each other forms an acute angle with a direction in which the cleaning robot 100 is scheduled to be driven in a state in which the cleaning robot 100 is parallel to a floor surface on which the cleaning robot 100 is driven, before the driving of the cleaning robot 100 while generating the pushing force. The straight line may be a straight line 'L' as shown in FIG. 7, which connects rotation centers of the rotation members 110 and 120 to each other when the cleaning robot 100 is viewed vertically from above. The angle formed with the direction in which the cleaning robot 100 is scheduled to be driven or a distance corresponding thereto (hereinafter, 'start angle/distance') between the wall surface 800 and a distance detection unit 130 may be stored in a storage unit. The acute angle may refer to an angle greater than zero degree and smaller than 90 degrees, and may be, for example, a predetermined acute angle of 40 degrees or more, and it is possible to control a posture of the cleaning robot 100 using this angle as a basic target value.

According to the control method of the cleaning robot 100 in an embodiment of the present disclosure, in the driving of the cleaning robot 100 while generating the pushing force (see FIG. 7C), a rotational speed of at least one of the first rotation member 110 and the second rotation member 120 may be controlled to generate the pushing force by allowing the cleaning robot 100 to be driven along the wall surface 800 while maintaining the acute angle (hereinafter, 'diagonal driving'). As a specific example, the following method may be applied: the cleaning robot first starts its diagonal driving by allowing the rotational speeds of the rotation members 110 and 120 to be the same, a deviation between the starting angle/distance and the angle/distance in the current driving state is searched for during its diagonal driving, the deviation is made to be zero or within a predetermined range by controlling the rotational speeds of the rotating members 110 and 120 to compensate for the deviation, and the cleaning robot 100 then restarts its diagonal driving.

Figure 8:
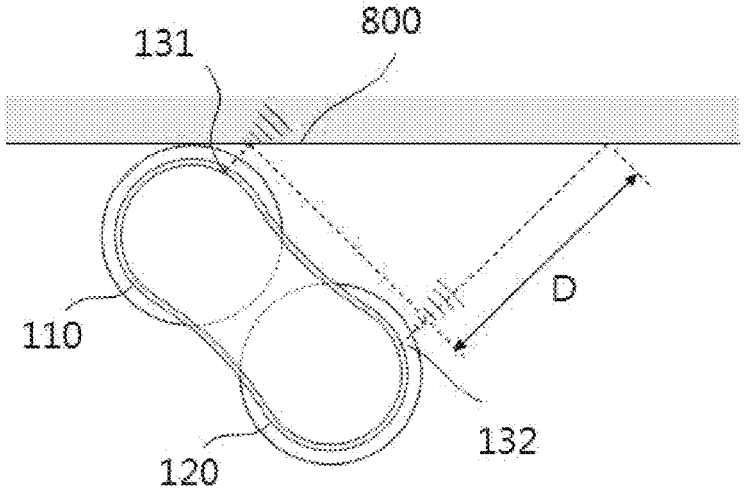
FIG. 8 is a view for describing a control method for driving the cleaning robot according to an embodiment of the present disclosure.

FIG. 8 is a view for describing a control method for driving the cleaning robot 100 according to an embodiment of the present disclosure. The distance detection unit 130 may include a first distance detection unit 131 and a second distance detection unit 132 respectively disposed on the left and right sides of the body 10 of the cleaning robot 100, and in the driving of the cleaning robot 100 while generating the pushing force, the rotational speed may be controlled to maintain the acute angle in such a manner that a first reference value is maintained as a value of a difference D in a distance between the distance detection unit 130 and the wall surface 800 obtained through the first distance detection unit 131 and that obtained through the second distance detection unit 132. The first reference value may be a value corresponding to the start angle/distance. The distance detection unit 130 may be a sensor capable of detecting a distance, and an infrared ray (IR) sensor, or a position sensing device (PSD) sensor may be used as the first distance detection unit 131 and the second distance detection unit 132. The position sensing device (PSD) sensor is a sensor that measures a distance by an infrared triangulation method, and may have one system including an infrared light emitting diode, lens and one-dimensional charge coupled device (CCD) sensor.

The cleaning robot 100 may include at least one distance detection unit 130, and in the determining of whether the cleaning robot 100 reaches the wall surface 800 (S110), it may be determined whether the cleaning robot 100 reaches the wall surface 800 based on a distance between the distance detection unit 130 and the wall surface 800 obtained through the distance detection unit 130.

Figure 9A:
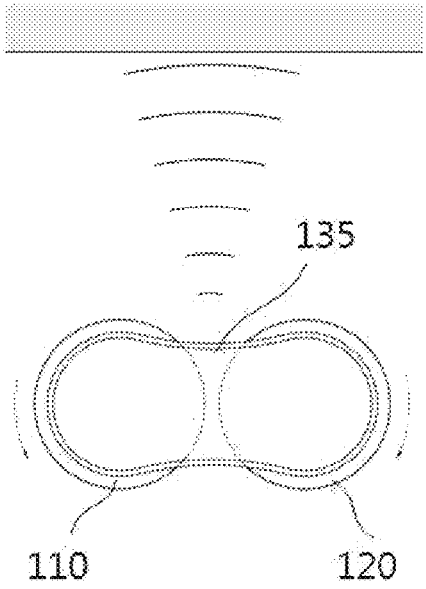
FIGS. 9A and 9B are views for describing a method of determining whether the cleaning robot reaches the wall surface according to an embodiment of the present disclosure.
Figure 9B:
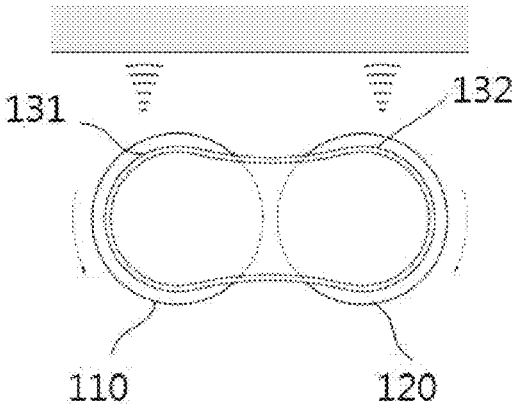
Figure 10A:
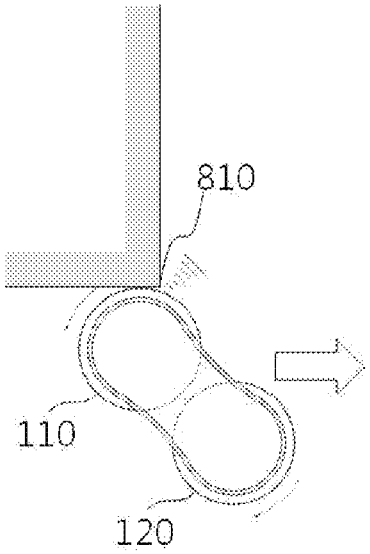
FIGS. 10A to 10D are views for describing a method of the cleaning robot to detect a wall surface edge and make a smooth turn according to an embodiment of the present disclosure.
Figure 10B:
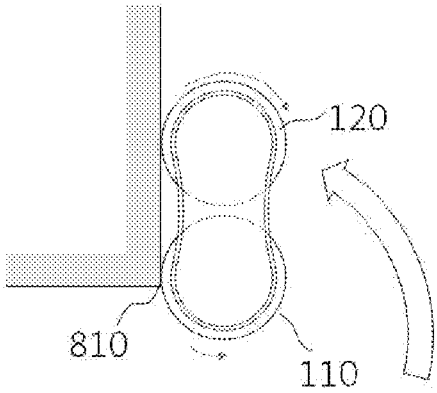
Figure 10C:
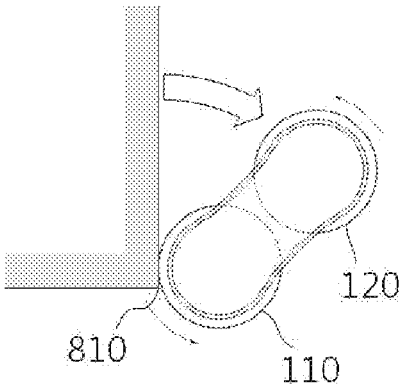
Figure 10D:
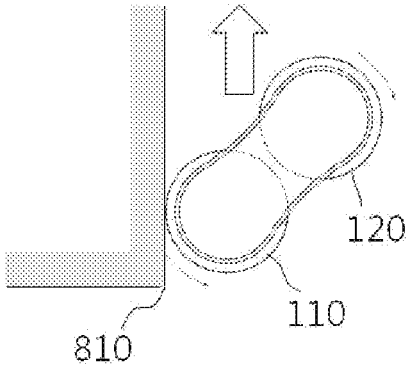

FIG. 9 is a view for describing a method of determining whether the cleaning robot 100 reaches the wall surface 800 according to an embodiment of the present disclosure. As shown in FIG. 9, the distance detection unit 130 may include a long distance detection unit 135 and short distance detection units 131 and 132, and the determining of whether the cleaning robot 100 reaches the wall surface 800 (S110) may include: determining whether a distance between the distance detection unit 130 and the wall surface 800 obtained through the long distance detection unit 135 has a value less than or equal to a predetermined sixth reference value; determining whether the distance between the distance detection unit 130 and the wall surface 800 obtained through the short distance detection units 131 and 132 has a value less than or equal to a predetermined seventh reference value, while maintaining a driving state of the cleaning robot 100, when it is determined that the distance has the value less than or equal to the sixth reference value; and determining that the cleaning robot reaches the wall surface 800 when it is determined that the distance has the value less than or equal to the seventh reference value. The long distance detection unit 135 may be the infrared ray (IR) sensor or the like.

In addition, the determining of whether the cleaning robot 100 reaches the wall surface 800 may further include determining that the cleaning robot 100 reaches the wall surface 800 when a predetermined time elapses after the distance between the distance detection unit 130 and the wall surface 800 obtained through the long distance detection unit 135 is determined to be less than or equal to the sixth reference value even if it is not determined that the distance between the distance detection unit 130 and the wall surface 800 obtained through the short distance detection units 131 and 132 is less than or equal to the seventh reference value.

FIG. 10 is a view for describing a method of the cleaning robot to detect a wall surface edge and make a smooth turn according to an embodiment of the present disclosure. As shown in FIG. 10, the driving of the cleaning robot 100 along the wall surface 800 (S120) may further include: determining that the cleaning robot 100 reaches a wall surface edge 810 when a distance between the distance detection unit 130 and the wall surface 800 obtained through the distance detection unit 130 has a value more than a predetermined second reference value or the magnitude of a distance detection signal of the distance detection unit 130 has a value less than a predetermined third reference value (see FIG. 10A); rotating the cleaning robot 100 to be in close contact with the wall surface 800 which is subsequently connected to the wall surface edge 810 when it is determined that the cleaning robot 100 reaches the wall surface edge 810 (see FIG. 10B); and driving the cleaning robot 100 along the wall surface 800 which is subsequently connected to the wall surface edge 810 by rotating at least one of the first rotation member 110 and the second rotation member 120 in such a manner that the cleaning robot 100 maintains its close contact with the wall surface 800 which is subsequently connected to the wall surface edge 810, when the cleaning robot 100 is in close contact with the wall surface 800 which is subsequently connected to the wall surface edge 810 (see FIGS. 10C and D). Accordingly, the cleaning robot 100 may easily continue the cleaning past the wall edge section while maintaining its close contact with the wall surface 800. Here, the distance detection signal may refer to a signal output from the distance detection unit 130, and may have weak intensity when the distance detection unit 130 detects no obstacle or an obstacle located far therefrom.

Figure 11A:
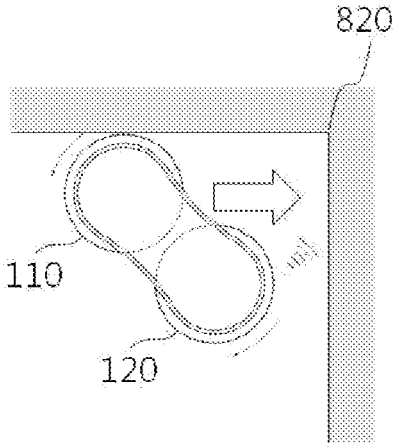
FIGS. 11A to 11C are views for describing a method of the cleaning robot to detect a wall surface corner and make a corner turn according to an embodiment of the present disclosure.
Figure 11B:
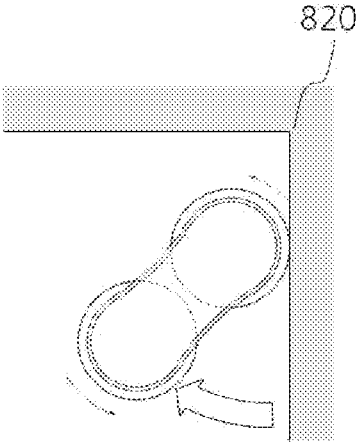
Figure 11C:
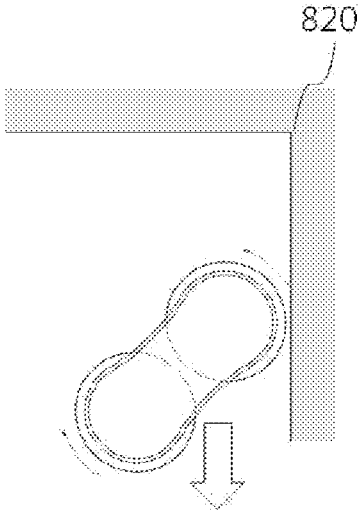

FIG. 11 is a view for describing a method of the cleaning robot to detect a wall surface corner and make a corner turn according to an embodiment of the present disclosure. As shown in FIG. 11, the driving of the cleaning robot 100 along the wall surface 800 (S120) may further include: determining that the cleaning robot 100 reaches a wall surface corner 820 when a distance between the distance detection unit 130 and the wall surface 800 obtained through the distance detection unit 130 has a value less than a predetermined fourth reference value or the magnitude of a distance detection signal of the distance detection unit 130 has a value more than a predetermined fifth reference value (see FIG. 11A); rotating the cleaning robot 100 to be in close contact with the wall surface 800 which is subsequently connected to the wall surface corner 820 when it is determined that the cleaning robot 100 reaches the wall surface corner 820 (see FIG. 11B); and driving the cleaning robot 100 along the wall surface 800 which is subsequently connected to the wall surface corner 820 by rotating at least one of the first rotation member 110 and the second rotation member 120 in such a manner that the cleaning robot 100 maintains its close contact with the wall surface 800 which is subsequently connected to the wall surface corner 820, when the cleaning robot 100 is in close contact with the wall surface 800 which is subsequently connected to the wall surface corner 820 (see FIG. 11C).

Figure 12:
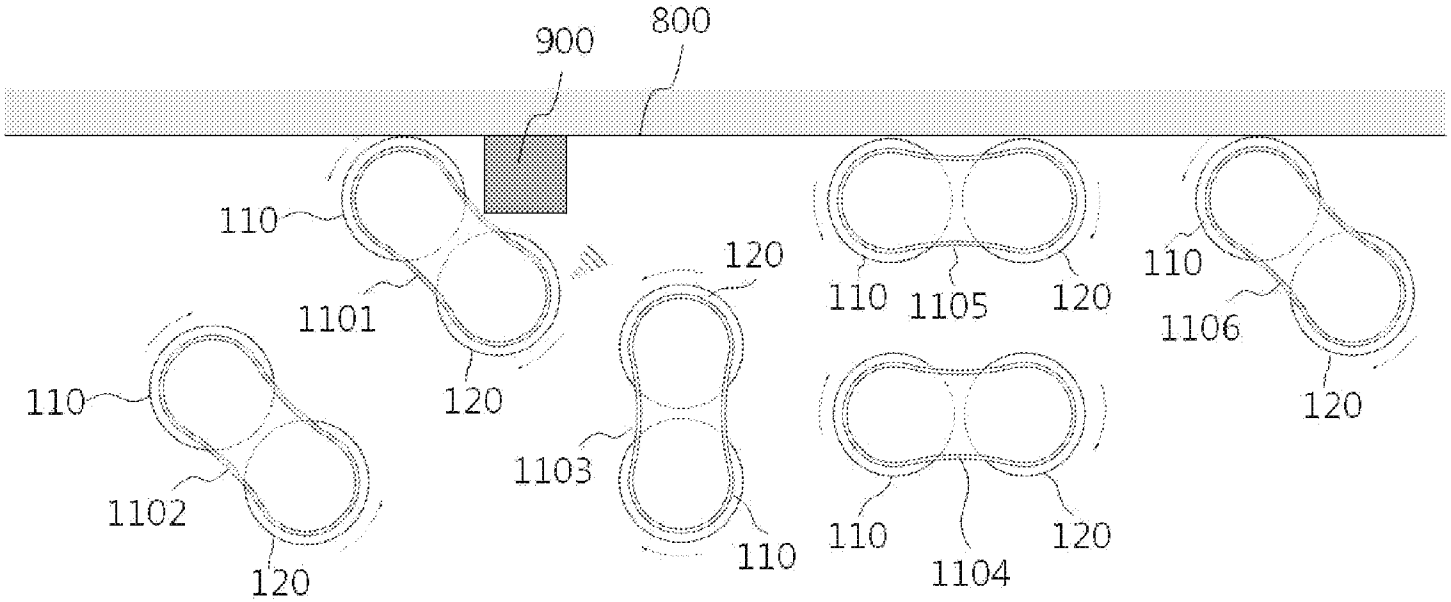
FIG. 12 is a view for describing an operation of the cleaning robot in an obstacle avoidance mode according to an embodiment of the present disclosure.

FIG. 12 is a view for describing an operation of the cleaning robot in an obstacle avoidance mode according to an embodiment of the present disclosure. The driving of the cleaning robot 100 along the wall surface 800 (S120) may further include changing a mode of the cleaning robot 100 to an obstacle avoidance mode when trouble occurs in the driving of the cleaning robot 100 due to an obstacle 900 (Operation 1101), the obstacle avoidance mode including a process in which the cleaning robot 100 is driven to be spaced apart from the wall surface 800 (Operation 1102) for a predetermined distance or time (Operation 1103) and is then brought into close contact with the wall surface 800 again (Operations 1104 and 1105), and the driving of the cleaning robot 100 along the wall surface 800 (S120) may be restarted (Operation 1106) as the obstacle avoidance mode is released after the cleaning robot 100 is brought into close contact with the wall surface 800 again. Here, the cleaning robot 100 may be spaced apart from the wall surface 800 by being driven backward.

In addition, in the driving of the cleaning robot 100 along the wall surface 800 (S120), the cleaning robot 100 may preferably be maintained to be driven by a distance of at least twice a width of its body 10 along the wall surface 800.

Meanwhile, the control method according to various embodiments of the present disclosure described above may be implemented by a program code and be provided in the respective servers or apparatuses in a state in which it is stored in various non-transitory computer readable medium.

The non-transitory computer readable medium is not a medium that stores data therein for a while, such as a register, a cache, a memory or the like, but a medium that semi-permanently stores data therein and is readable by an apparatus. In detail, the various applications or programs described above may be stored and provided in the non-transitory computer readable medium such as a compact disk (CD), a digital versatile disk (DVD), a hard disk, a blu-ray disk, a universal serial bus (USB), a memory card, a read only memory (ROM) or the like.

In addition, although the embodiments of the present disclosure have been illustrated and described hereinabove, the present disclosure is not limited to the above-mentioned specific embodiments, but may be variously modified by those skilled in the art to which the present disclosure pertains without departing from the scope and spirit of the present disclosure as disclosed in the accompanying claims. These modifications should also be understood to fall within the scope of the present disclosure.

The invention claimed is:

1. A control method of a cleaning robot using a rotational force of a plurality of rotation members as a motive power source for driving the cleaning robot, the control method of a cleaning robot comprising:

driving the cleaning robot by rotating at least one of a first rotation member performing a rotational motion around a first rotation axis and a second rotation member performing a rotational motion around a second rotation axis;

determining whether the cleaning robot reaches a wall surface during the driving; and driving the cleaning robot along the wall surface by rotating at least one of the first and second rotation members while maintaining one side surface of the cleaning robot to be in close contact with the wall surface when it is determined that the cleaning robot reaches the wall surface, wherein the driving of the cleaning robot along the wall surface includes driving the cleaning robot while generating a pushing force between the cleaning robot and the wall surface by rotating at least one of the first rotation member and the second rotation member to maintain the cleaning robot to be in close contact with the wall surface, wherein the driving of the cleaning robot along the wall surface further includes rotating the cleaning robot in such a manner that a straight line connecting the first rotation axis and the second rotation axis to each other forms an acute angle with a direction in which the cleaning robot is scheduled to be driven in a state in which the cleaning robot is parallel to a floor surface on which the cleaning robot is driven, before the driving of the cleaning robot while generating the pushing force, and in the driving of the cleaning robot while generating the pushing force, a rotational speed of at least one of the first rotation member and the second rotation member is controlled to generate the pushing force by allowing the cleaning robot to be driven along the wall surface while maintaining the acute angle, wherein the cleaning robot includes at least one distance detection unit, and in the driving of the cleaning robot while generating the pushing force, the rotational speed is controlled based on a distance between the distance detection unit and the wall surface obtained through the distance detection unit to maintain the acute angle, and wherein the distance detection unit includes a first distance detection unit and a second distance detection unit respectively disposed on left and right sides of a body of the cleaning robot, and in the driving of the cleaning robot while generating the pushing force, the rotational speed is controlled to maintain the acute angle in such a manner that a predetermined first reference value is maintained as a value of a difference in the distance between the distance detection unit and the wall surface obtained through the first distance detection unit and that obtained through the second distance detection unit.

2. The control method of a cleaning robot of claim 1, wherein the cleaning robot includes at least one distance detection unit, and the driving of the cleaning robot along the wall surface further includes:

determining that the cleaning robot reaches a wall surface edge when a distance between the distance detection unit and the wall surface obtained through the distance detection unit has a value more than a predetermined second reference value or a magnitude of a distance detection signal of the distance detection unit has a value less than a predetermined third reference value;

rotating the cleaning robot to be in close contact with the wall surface which is subsequently connected to the wall surface edge when it is determined that the cleaning robot reaches the wall surface edge; and driving the cleaning robot along the wall surface which is subsequently connected to the wall surface edge by rotating at least one of the first rotation member and the second rotation member in such a manner that the cleaning robot maintains the close contact with the wall surface which is subsequently connected to the wall surface edge, when the cleaning robot is in close contact with the wall surface which is subsequently connected to the wall surface edge.

3. The control method of a cleaning robot of claim 1, wherein the cleaning robot includes at least one distance detection unit, and the driving of the cleaning robot along the wall surface further includes:

determining that the cleaning robot reaches a wall surface corner when a distance between the distance detection unit and the wall surface obtained through the distance detection unit has a value less than a predetermined fourth reference value or the magnitude of a distance detection signal of the distance detection unit has a value more than a predetermined fifth reference value;

rotating the cleaning robot to be in close contact with the wall surface which is subsequently connected to the wall surface corner when it is determined that the cleaning robot reaches the wall surface corner; and driving the cleaning robot along the wall surface which is subsequently connected to the wall surface corner by rotating at least one of the first rotation member and the second rotation member in such a manner that the cleaning robot maintains the close contact with the wall surface which is subsequently connected to the wall surface corner, when the cleaning robot is in close contact with the wall surface which is subsequently connected to the wall surface corner.

4. The control method of a cleaning robot of claim 1, wherein in the driving of the cleaning robot along the wall surface, the cleaning robot is driven by a distance of at least twice a width of the body along the wall surface.

5. The control method of a cleaning robot of claim 1, wherein the cleaning robot includes at least one distance detection unit, and in the determining of whether the cleaning robot reaches the wall surface, it is determined whether the cleaning robot reaches the wall surface based on a distance between the distance detection unit and the wall surface obtained through the distance detection unit.

6. The control method of a cleaning robot of claim 5, wherein the distance detection unit includes a long distance detection unit and a short distance detection unit, and the determining of whether the cleaning robot reaches the wall surface includes:

determining whether the distance between the distance detection unit and the wall surface obtained through the long distance detection unit has a value less than or equal to a predetermined sixth reference value;

determining whether the distance between the distance detection unit and the wall surface obtained through the short distance detection unit has a value less than or equal to a predetermined seventh reference value, while maintaining a driving state of the cleaning robot, when it is determined that the distance has the value less than or equal to the predetermined sixth reference value; and determining that the cleaning robot reaches the wall surface when it is determined that the distance has the value less than or equal to the predetermined seventh reference value.

7. The control method of a cleaning robot of claim 6, wherein the determining of whether the cleaning robot reaches the wall surface further includes determining that the cleaning robot reaches the wall surface when a predetermined time elapses after the distance between the distance detection unit and the wall surface obtained through the long distance detection unit is determined to be less than or equal to the predetermined sixth reference value even if it is not determined that the distance between the distance detection unit and the wall surface obtained through the short distance detection unit is less than or equal to the predetermined seventh reference value.

8. The control method of a cleaning robot of claim 1, wherein the driving of the cleaning robot along the wall surface further includes changing a mode of the cleaning robot to an obstacle avoidance mode when trouble occurs in the driving of the cleaning robot due to an obstacle, the obstacle avoidance mode including a process in which the cleaning robot is driven to be spaced apart from the wall surface for a predetermined distance or time and is then brought into close contact with the wall surface again, and the driving of the cleaning robot along the wall surface is restarted as the obstacle avoidance mode is released after the cleaning robot is brought into close contact with the wall surface again.

* * * * *